US010192660B2

(12) United States Patent
Karunaratne et al.

(10) Patent No.: US 10,192,660 B2
(45) Date of Patent: Jan. 29, 2019

(54) PROCESS FOR PREPARATION OF NANOPARTICLES FROM MAGNETITE ORE

(75) Inventors: Veranja Karunaratne, Kandy (LK); Gayan Priyadharshana, Pelmadulla (LK); Sunanda Gunasekara, Pillyandala (LK); Nilwala Kottegoda, Horana (LK); Atula Senaratne, Peradeniya (LK)

(73) Assignee: Sri Lanka Institute of Nanotechnology (PVT) Ltd., Walgama (LK)

( * ) Notice: Subject to any disclaimer, the term of this patent is extended or adjusted under 35 U.S.C. 154(b) by 1403 days.

(21) Appl. No.: 13/176,515

(22) Filed: Jul. 5, 2011

(65) Prior Publication Data

US 2012/0056121 A1 Mar. 8, 2012

Related U.S. Application Data

(60) Provisional application No. 61/361,092, filed on Jul. 2, 2010.

(51) Int. Cl.

| | |
|---|---|
| ***B01F 3/12*** | (2006.01) |
| ***B01F 7/00*** | (2006.01) |
| ***H01F 1/00*** | (2006.01) |

(52) U.S. Cl.

CPC ..... *H01F 1/0054* (2013.01); *B01F 3/12* (2013.01); *B01F 3/1214* (2013.01); *B01F 7/005* (2013.01); *Y10S 977/838* (2013.01)

(58) Field of Classification Search

CPC ... C09G 49/08; C01P 2006/42; H01F 1/0054; B01F 7/005; B01F 3/12; B01F 3/1214; Y10S 977/838

USPC ..... 516/33; 252/62.56; 977/838; 241/15, 241/16, 21, 29, 24.14; 423/632; 106/456, 460, 504, 286.3, 287.18, 287.24, 106/287.26; 75/10.67; 209/39

See application file for complete search history.

(56) References Cited

U.S. PATENT DOCUMENTS

| | | | | |
|---|---|---|---|---|
| 2,719,009 | A * | 9/1955 | Szegvari | 241/16 |
| 3,215,572 | A * | 11/1965 | Papell | 149/2 |
| 3,917,538 | A * | 11/1975 | Rosensweig | 252/62.52 |
| 4,246,331 | A * | 1/1981 | Mehl et al. | 430/110.2 |
| 4,430,239 | A * | 2/1984 | Wyman | 252/62.53 |
| 5,312,602 | A * | 5/1994 | Svensson et al. | 423/633 |

(Continued)

FOREIGN PATENT DOCUMENTS

| | | | | |
|---|---|---|---|---|
| EP | 2 031 607 A1 * | 3/2009 | | |
| WO | WO 2008/036075 A2 * | 3/2008 | | |
| WO | WO-2010046789 A1 * | 4/2010 | | B29C 41/003 |

OTHER PUBLICATIONS

Kirk Othmer Encyclopedia of Chemical Technology, "Fats and Fatty Oils", G. L. Hasenhuettl as Consultant, © 2005 by John Wiley & Sons, Inc. (Available Online: Feb. 18, 2005), pp. 801-836, obtained Online @ http://m rw.interscience.wiley.com/emrw/9780471238966/search/firstpage (downloaded Jun. 19, 2010).*

(Continued)

*Primary Examiner* — Daniel S Metzmaier

(74) *Attorney, Agent, or Firm* — Alston & Bird LLP

(57) ABSTRACT

The compositions and methods herein relate to stable dispersions of long chain carboxylic acid-stabilized magnetite nanoparticles dispersed in alcohol. These compositions are useful in advanced biomedical applications.

5 Claims, 6 Drawing Sheets

| | Diam. (nm) | % Intensity | Width (nm) |
|---|---|---|---|
| Peak 1: | 21.04 | 100.0 | 0.000 |
| Peak 2: | 0.000 | 0.0 | 0.000 |
| Peak 3: | 0.000 | 0.0 | 0.000 |

(56) References Cited

U.S. PATENT DOCUMENTS

| | | | | |
|---|---|---|---|---|
| 5,427,767 | A * | 6/1995 | Kresse et al. | 514/56 |
| 5,799,882 | A * | 9/1998 | Klimpel | 241/16 |
| 6,117,225 | A * | 9/2000 | Nicolls | 106/31.65 |
| 2005/0191231 | A1* | 9/2005 | Sun | 423/632 |
| 2006/0118206 | A1* | 6/2006 | Sato | 252/62.55 |

OTHER PUBLICATIONS

Kirk Othmer Encyclopedia of Chemical Technology, "Carboxylic Acids, Manufacture", R. W. Johnson and R. W. Daniels, Union Camp Corporation, © 1993 by John Wiley & Sons, Inc. (Article Online Date: Dec. 4, 2000), pp. 1-10 obtained Online @ http://m rw.interscience.wiley.com/emrw/9780471238966/search/firstpage (downloaded Jun. 19, 2010).*

Ullmann's Encyclopedia of Industrial Chemistry, 5th, Completely Revised Ed., vol. A 10: Ethanolamines to Fibers, 4. Synthetic Organic, Edited by Wolfgang Gerhartz et al, copyright 1987, VCH Verlagsgesellschaft mbH, D-6940 Weinheim, Fed. Rep. of Germany (Received date: May 1994), pp. 176-177 and 231-232.*

Papel and Faber, Jr., NASA Technical Note, "On the Influence of Nonuniform Magnetic Fields on Ferromagnetic Colloidal Sols", vol. (NASA-TN-D-4676), (1968) pp. 1-25.*

"Fritsch Planeten-Mikromuhle Pulverisette 7 premium line Operating Manual", Fritsch GmbH, Idar-Oberstein, Germany, online @ http://www.johnmorris.com.au/files/product/attachments/16327/266795_manual_instr.pdf , (Jun. 2007), pp. 1-48.*

Industrial Solvents Handbook, 2nd Ed., Edited by Ibert Mellan, Noyes Data Corp., Park Ridge, NJ, USA, Copyright 1977, pp. 216-217 and 230.*

* cited by examiner

| | Diam. (nm) | % Intensity | Width (nm) |
|---|---|---|---|
| Peak 1: | 32.67 | 100.0 | 0.000 |
| Peak 2: | 0.000 | 0.0 | 0.000 |
| Peak 3: | 0.000 | 0.0 | 0.000 |

| | Diam. (nm) | % Intensity | Width (nm) |
|---|---|---|---|
| Peak 1: | 21.04 | 100.0 | 0.000 |
| Peak 2: | 0.000 | 0.0 | 0.000 |
| Peak 3: | 0.000 | 0.0 | 0.000 |

PROCESS FOR PREPARATION OF NANOPARTICLES FROM MAGNETITE ORE

CROSS-REFERENCE TO RELATED APPLICATIONS

This application claims priority under 35 U.S.C. § 119 to provisional application Ser. No. 61/361,092, filed Jul. 2, 2010, which application is hereby incorporated by reference in its entirety.

FIELD OF THE INVENTION

This invention relates to a process for the preparation of nanoparticles from magnetite ore.

BACKGROUND OF THE INVENTION

Currently, there is a great desire to prepare magnetic nanoparticles. Out of the many types of magnetic nanoparticles, iron oxides, particularly magnetite has attracted considerable attention in recent times. Magnetite ($Fe_3O_4$) particles are used in various industrial applications such as magnetic seals in motors, magnetic inks for bank cheques, magnetic recording media and biomedical applications. The latter application can include contrast agents for diagnostics and magnetic field-guided carriers for localizing drugs or radioactive therapeutic systems. Currently, there are several chemical methods available for synthesizing magnetite nanoparticles. However, in general, methods to prepare nanoparticles of uniform and well defined crystallinity are rare. Application performances are enhanced at nanometer levels when production methods provide uniform and well defined particles. Further, the agglomeration of particles should be properly controlled for advanced biomedical applications. Typically, synthetic methods are used to prepare magnetite nanoparticles where co-precipitation of ferrous ion ($Fe^{+2}$) and ferric ion ($Fe^{+3}$) with addition of ammonia is generally used. Typically, in these processes the control of pH is very important in controlling the size of nanoparticles. Like many precipitation reactions, the nucleation and growth steps determine the size of nanoparticles. Jeong et al., Nanomagnetite particles prepared under the combined addition of urea and ammonia, Key Engineering Materials, Vols 317-318, (2006), pp. 203-206, have proposed a mechanism of $Fe_3O_4$ precipitation through $\alpha$-FeOOH as an intermediate phase.

Aqueous precipitation methods for magnetite nanoparticle formation are commonly practiced and generally include surfactants and polymers as stabilizers. U.S. Pat. No. 6,962,685 B2 to Sun describes the synthesis of magnetite nanoparticles by co-precipitation of a mixture of $Fe^{+2}$ and $Fe^{+3}$ salts in the presence of a strong base. To make stable dispersions of magnetite nanoparticles several stabilizers such as long chain alkyl carboxylic acids and alkyl ammonium cations are used.

Commonly in the preparation of magnetite nanoparticles from the natural ore using chemical methods, the ore is dissolved in strong acids followed by co-precipitation using a base. In the preparation of magnetite nanoparticles from high purity natural ores, physical methods such as wet grinding are highly desirable. Furthermore, wet grinding in the presence of a stabilizer would avoid the use of acids and bases and therefore would be of low cost because it involves a one pot synthetic method leading to stabilized magnetite nanoparticles. In addition, such methods would be less hazardous and lower in carbon foot print.

Since in many cases of nanoparticles the agglomeration of particles should be properly controlled for advanced applications, there is a need for processes to provide well defined nanoparticles without agglomeration.

BRIEF SUMMARY OF THE INVENTION

Accordingly, provided herein is a process for producing a dispersion of high purity magnetite nanoparticles from the natural ore. The dispersion medium forms a continuous phase while the particles are present as a discontinuous phase. The nanoparticles are reacted with a long chain alkyl carboxylic acid which as a reactive stabilizer; an added alcohol such as ethanol serves as the continuous phase. In an embodiment oleic acid acts as a reactive stabilizer to form nanoparticles that are dispersed in the continuous phase. Oleic acid is added during wet grinding of the magnetite ore to facilitate its destructuring and the carboxyl groups of the oleic acid reacts with the hydroxyl groups of the magnetite ore, to provide stability during formation of nanoparticles.

Also provided herein are nanoparticles of 32 nm that are produced by this process to give a dispersion in ethanol that has zeta potential of about +42 mV. In another embodiment, nanoparticles having average particle size of about 20 nm, present in a dispersion of ethanol have a zeta potential greater than +40 mV.

DETAILED DESCRIPTION OF THE INVENTION

Figure 1:
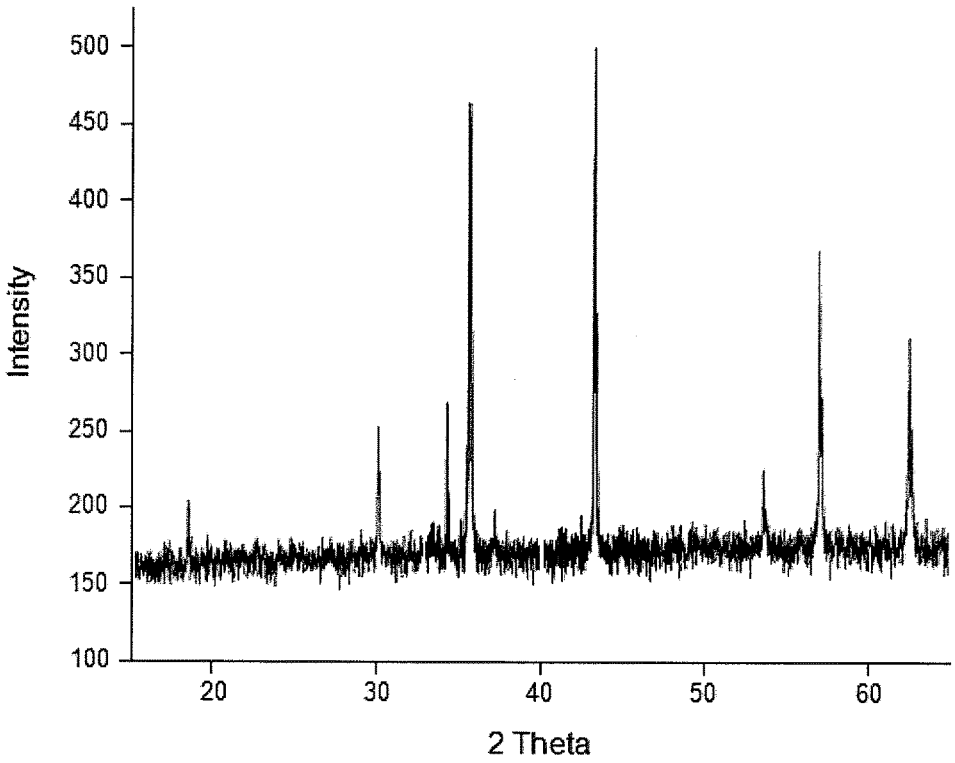
FIG. 1. Powder X-ray diffraction pattern of magnetite ore found in Matale, Sri Lanka FIG. 2. SEM image of magnetite powdered ore found in Matale, Sri Lanka FIG. 3. Particle size distribution for the dispersion prepared using 1 mm zirconium oxide grinding balls

The grinding of the ore in the presence of liquid stabilizers containing polar groups provides for them to be in contact with the hydroxyl groups of the ground magnetite ore and thus allows stabilization of the resulting nanoparticles. The wet grinding process herein gives rise to nanoparticles with a narrow particle size distribution and provides for stabilization against particulate material agglomeration. The addition of a polar solvent to the stabilized magnetite nanoparticles gives rise to a stable transparent dispersion of the nanoparticles.

Definitions

As referred to herein magnetite ore includes all types of magnetite ores. The purity of the magnetite ores is preferably between about 90 and 98 percent (referred to as high purity magnetite ores). Magnetite ores with purity between about 80 to 90 percent can also be used.

As referred to herein the term "destructured" refers to a reduction in size of the magnetite ore particulate that is to be processed into nanoparticles. The term "agglomerated particles" is intended to mean particles that have not been processed to reduce particle sizes to the nanosize level, and particles that combine during or after particulate have been destructured. The term "agglomerated particles" includes particles that are combined after particles have been destructured and dispersed in alcoholic media.

The term "nanoparticle" and its plural form referred to herein is a particle having a size in the range of 10 to 1000 nm. In one embodiment, the nanoparticles of the present invention are in the range from about 10 to 250 nm, from about 20 to 250 nm, from about 30 to 250 nm, from about 10 to 200 nm, preferably from about 20 to 200 nm, 30 to 200 nm, or 50 to 150 nm, with a mean and/or average size of the nanoparticles of about 150 nm. Particle size measurements were obtained using a Malvern NanoZS particle size analyzer model number ZEN3600.

As referred to herein the surface Fe atoms that are not bound to oxygen atoms can act as Lewis acids and coordinate with molecules that donate lone pair electrons, Lewis bases. In aqueous systems the surface oxygen atoms bound to Fe atoms undergo protonation with water to form surface hydroxyl groups. Surface hydroxyl groups are amphoteric and may react with either acids or bases. In aqueous dispersions the surface of magnetite will be either positive or negative, depending on the pH of the solution.

As referred to herein the bound stabilizer is a long chain carboxylic acid molecule that reacts with the surface hydroxyl groups of magnetite. The long chain carboxylic acids preferably have C12 to C18 carbon atoms in the alkyl chain. Suitable long chain carboxylic acids are capric acid, lauric acid, myristic acid, oleic acid and palmitic acid. The long chain carboxylic acid may be linear, branched and can contain unsaturated groups such as double bonds within the alkyl chain. The stabilizer can be natural oil containing long chain carboxylic acid carboxyl groups.

Stabilization of magnetite nanoparticles can be achieved by changing the electrostatic double layer, steric stabilization or by modifying the isoelectric point by adding surfactants.

As referred to herein, zeta potential is the electric potential in the interfacial double layers at the location of the slipping plane with regard to a point in the bulk fluid away from the interface. Zeta potential is the potential difference between the continuous phase or the dispersion medium and the stationary layer of fluid attached to the dispersed nanoparticles. Typically, a value of 25 mV positive or negative is an arbitrary value that separates low-charged surfaces from highly-charged surfaces. This value can be related to the stability as the zeta potential indicates the degree of repulsion between adjacent, similarly charged particles in dispersion. For nanoparticles a high zeta potential confers stability, i.e. the solution or dispersion resists forming agglomerated particles. When the potential is low either positive or negative, attraction exceeds repulsion and the dispersion flocculates to form the agglomerated particles.

Magnetite

Magnetite mineral occurs in nature in three main forms.

1. Primary magnetite in bands or in any other form in igneous rocks
2. Primary magnetite in bands or in any other form in metamorphic rocks
3. Disseminated magnetite in any igneous, metamorphic or sedimentary rocks.

Iron oxide exists in a variety of chemical compositions and with different magnetic properties and is shown Table 1. Iron oxides such as $\gamma$-$Fe_2O_3$, $Fe_3O_4$, FeO and $MO.Fe_2O_3$ (where M is Mn, Co, Ni, or Cu) can display ferromagnetism. Ferromagnetic iron oxides inherently display a lower magnetic response than ferromagnetic materials, such as the transition metals and their oxides. High purity magnetite ores can be found in the provinces of Sri Lanka; Matale, in the Central Province, and Buttala and Bibile in the Uva Province.

Magnetite ($Fe_3O_4$) has an inverse spinel crystal structure with face centered cubic unit cell where oxygen ions are placed regularly in cubic close packed positions along the [111] axis and the oxygen ion array contains holes partially filled with ferric and ferrous ions. The unit cell is comprised of 56 atoms: $32O^{2-}$ anions, $16Fe^{3+}$ cations and $8Fe^{2+}$ cations. The chemical formula of magnetite is $Fe_3O_4$, however more appropriately it is defined as $FeO.Fe_2O_3$. The inverse spinel structure is arranged such that half of the $Fe^{3+}$ ions are tetrahedrally coordinated and the remaining half of $Fe^{3+}$ and all of the $Fe^{2+}$ are octahedrally coordinated.

TABLE 1

Iron oxyhydroxide and iron oxide species

| Mineral | formula | Magnetic response |
|---|---|---|
| Goethite | α-FeOOH | antiferromagnetic |
| Akaganéite | β-FeOOH | antiferromagnetic |
| Lepidocrocite | γ-FeOOH | antiferromagnetic |
| Feroxyhyte | δ'-FeOOH | ferrimagnetic |
| Ferrihydrite | $Fe_5HO_8 \bullet 4H_2O$ | antiferromagnetic |
| Hematite | α-Fe2O3 | weakly ferromagnetic |
| Maghemite | γ-Fe2O3 | ferrimagnetic |
| Magnetite | Fe3O4 | ferrimagnetic |

Dispersion of Magnetite

In general, any size particulates of the magnetite to be destructured may be employed in the present invention, provided the particles are of a size which will permit the preparation of a dispersion useful in the desired application. The destructuring of the magnetite particulates may be accomplished by any means known to those having ordinary skill in the art. For example, destructuring may be accomplished by subjecting the particulates to processing in a ball mill, attriter mill, or pin mill. Although processing conditions will vary, depending upon the design and operation of the destructing means employed, suitable conditions may be readily determined by those having ordinary skill in the art. Destructuring typically is carried out through wet or dry grinding. Destructuring methods used by Papel and Faber, NASA Technical Note, Vol. (NASA-TN-D-4676), 1968, p. 25, required grinding the magnetic ore for periods of 500-1000 hours in the presence of surfactant to form nanoparticles of about 10 nm in diameter.

Nanoparticles formed during destructuring tend to agglomerate into large macroscopic aggregates. Such large aggregates are undesirable since they lead to non-uniform magnetic and physical properties. Bound stabilizers are preferred to prevent such agglomeration and the stabilizer can be a long chain carboxylic acid molecule that reacts with the surface hydroxyl groups of the magnetite. In an embodiment, the surface of the magnetite ore reacted with carboxyl group of oleic acid acts as the stabilizer to prevent the formed magnetite nanoparticles from agglomeration. In an embodiment, oleic acid, which is a non limiting example of a fatty acid containing 18 carbons, binds covalently to the surface of iron oxides. The stabilizer can also contain alcohol groups, such as natural polymeric materials or oils containing hydroxyl groups or carboxyl groups.

In an embodiment, in the applications of magnetic nanoparticles, the surface properties and chemistry are of great significance. In another embodiment, stabilization of the magnetite nanoparticles required to obtain magnetic colloidal ferrofluids, stable against aggregation in an applied magnetic field, can be obtained using the process described herein. These nanoparticles can be identified using color, scanning electron microscopy (SEM), transmission electron microscopy (TEM) and X-ray diffraction techniques (XRD).

In an embodiment of the process, grinding the magnetite ore in oleic acid under an inert atmosphere using a FRITSCH Planeten-Micromuhle Pulverisette 7 premium line Nano-Grinder for a period in the range of 0.5 to 1 hour with:

(a) 15 mm size tungsten carbide grinding balls at 700 rpm;

(b) further grinding using 5 mm size tungsten carbide grinding balls at 700 rpm;

(c) further grinding using 3 mm size zirconium oxide grinding balls at 1000 rpm;

(d) further grinding using 1 mm size zirconium oxide grinding balls at 1000 rpm; and (e) further grinding using 0.5 mm size zirconium oxide grinding balls at 1000 rpm.

Embodiment magnetite nanoparticles of 20 to 30 nm in size are obtained using the above grinding procedure. In a preferred embodiment, grinding under above conditions for 0.5 hours results in magnetite nanoparticles of 20 to 30 nm in size.

In an embodiment, the concentrated dispersions containing nanoparticles may be diluted in alcohols to obtain transparent solutions. Any short chain alcohol such as ethanol is added drop wise into 1 ml of oleic acid stabilized nanoparticles until a transparent and stable solution is obtained. In an embodiment the zeta potentials of the nanoparticles are in the range of +40 to +45 mV. Embodiment dispersions of nanoparticles maintained their stability without settling of particles for longer periods of greater than two months.

Uses of Magnetite

In one embodiment, the invention provides a magnetite nanoparticle that can confer magnetic properties to a substance or molecule of interest. It can act as a molecular tag or carrier. Thus, the magnetite nanoparticles of the invention can be used in monitoring the presence or amount of a desired substance in an assay, such as a bioassay, (environmental, diagnostic or other assay). Magnetite substances are used to tag and remove cancerous or other cells or substances from a biological environment in-vitro or in-vivo. Embodiment in-vivo applications, the magnetite nanoparticle should be biocompatible, in such way that it is not harmful to a subject upon administration. Embodiment magnetite nanoparticles can be mixed with suitable pharmaceutically acceptable carriers or excipients, as disclosed in Remington's Pharmaceutical Sciences, Mack Publishing Company, Easton, Pa., USA, 1985.

The present invention is further described by the examples which follow. Such examples, however, are not to be construed as limiting in any way either the spirit or the scope of the present invention.

EXAMPLES

Example 1

Characterization of Magnetite Ore

A sample of raw magnetite obtained from Matale, Sri Lanka, was crushed and characterized using, SEM/Energy Dispersive X-ray Analysis (EDX) and XRD.

Figure 2:
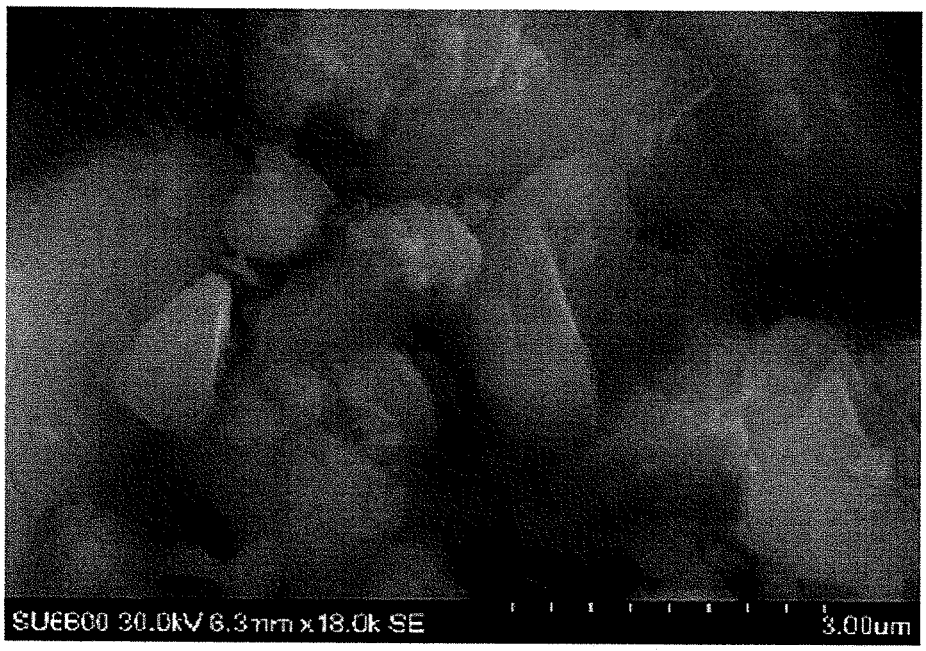

As seen from FIG. 1, the XRD pattern indicated the presence of only one phase of iron oxide comparing well with previously reported data for magnetite (Ma et al., Colloids and Surfaces A: Physicochem. Eng. Aspects, 212, (2003) pp. 219-226). FIG. 2 shows the SEM image of the powdered ore before subjecting to wet grinding. The elemental composition of the magnetite ore as indicated by EDX is: O (23.62%); Fe (75.05%); Mg (0.46%); Ti (0.47); Ca (0.13%).

Example 2

Preparation of Stabilized Magnetite Nanoparticles

Magnetite ore (20 g) was subjected to grinding in the presence of oleic acid (20 ml) using a FRITSCH Planeten-Micromuhle Pulverisette 7 premium line Nano-Grinder in an inert atmosphere as described below:

(a) 15 mm size tungsten carbide grinding balls at 700 rpm (b) further grinding using 5 mm size tungsten carbide grinding balls at 700 rpm (c) further grinding using 3 mm size zirconium oxide grinding balls at 1000 rpm (d) further grinding using 1 mm size zirconium oxide grinding balls at 1000 rpm (e) further grinding using 0.5 mm size zirconium oxide grinding balls at 1000 rpm.

Figure 3:
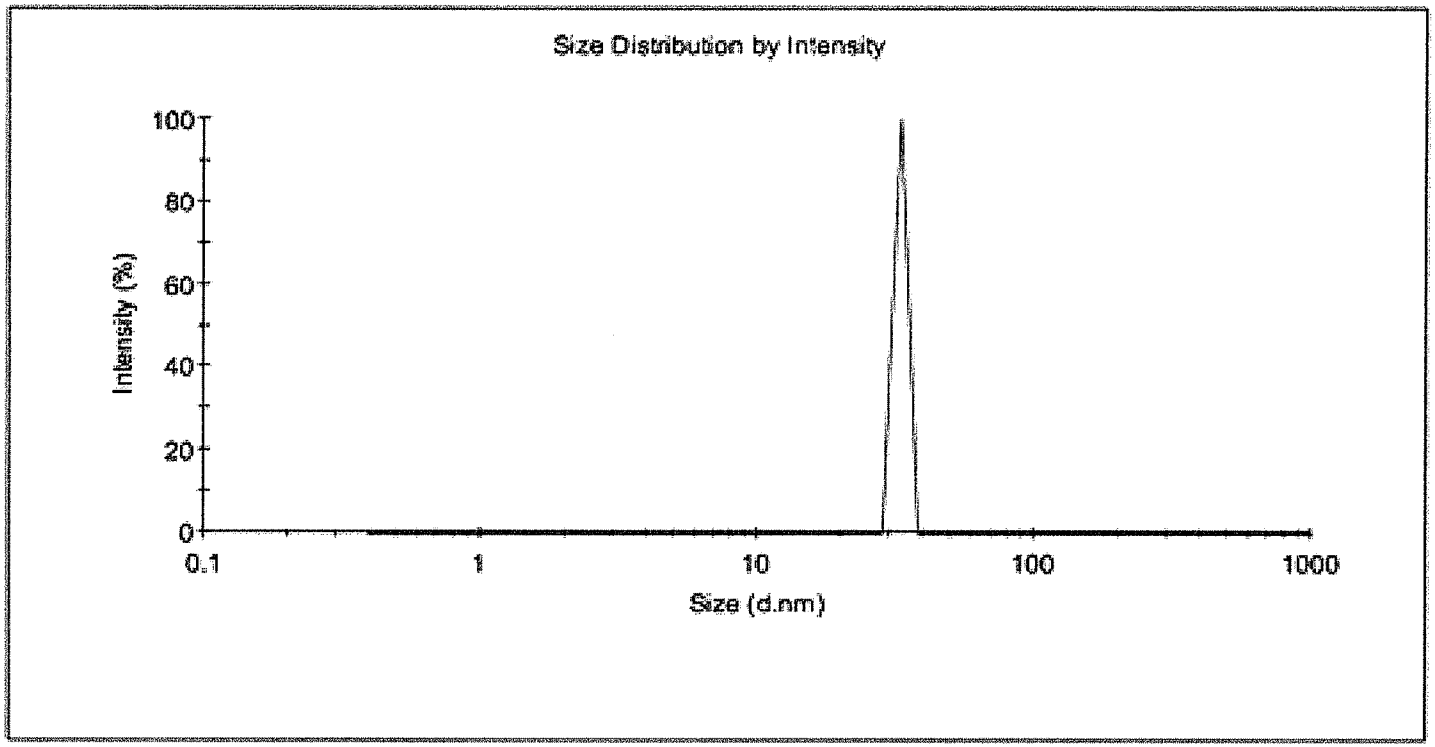
Figure 4:
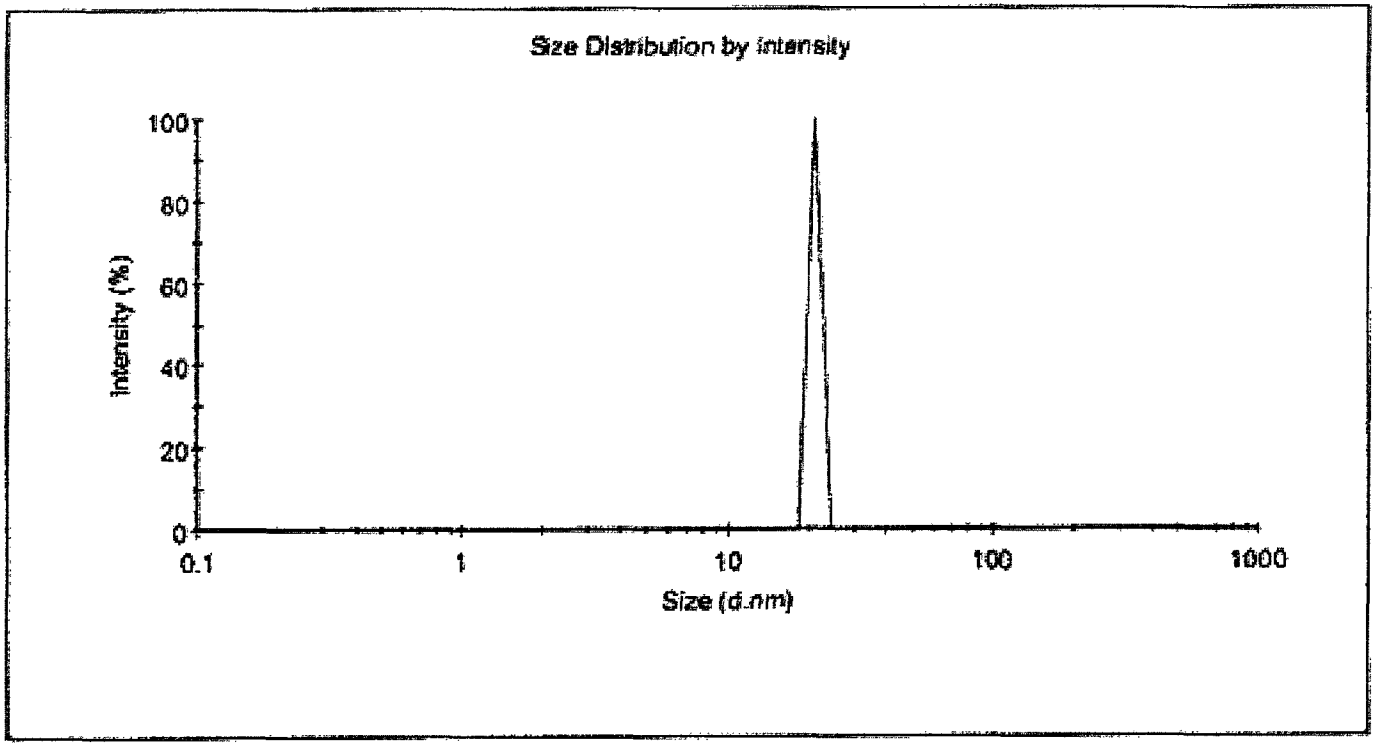
FIG. 4: Particle size distribution for the dispersion prepared using 0.5 mm zirconium oxide grinding balls FIG. 5. SEM images of mangnetite nanoparticles prepared using (a) 1 mm and (b) 0.5 mm zirconium oxide grinding balls in the final grinding stages FIG. 6. AFM image of magnetite nanoparticles prepared using 1 mm zirconium oxide grinding balls in the final grinding stages

This resulted in the formation of oleic acid stabilized magnetite nanoparticles as a suspension in oleic acid. Ethanol was added drop wise into 1 ml of oleic acid stabilized nanoparticles resulted from steps (a) to (d) or (a) to (e) until a clear and stable solution was obtained. The particle sizes observed for the dispersion prepared using 1 mm and 0.5 mm zirconium oxide grinding balls in the final grinding stages were 32 and 21 nm, respectively (see FIGS. 3 and 4); the observed zeta potentials of the nanoparticle dispersions were +40 and +42 mV, respectively. Nanoparticles maintained their stability without the settling of particles for more than two months.

The resulting stabilized magnetite nanoparticle dispersion was dried at 85° C. and the resulting nanoparticles were observed using SEM and AFM.

Figure 5A:
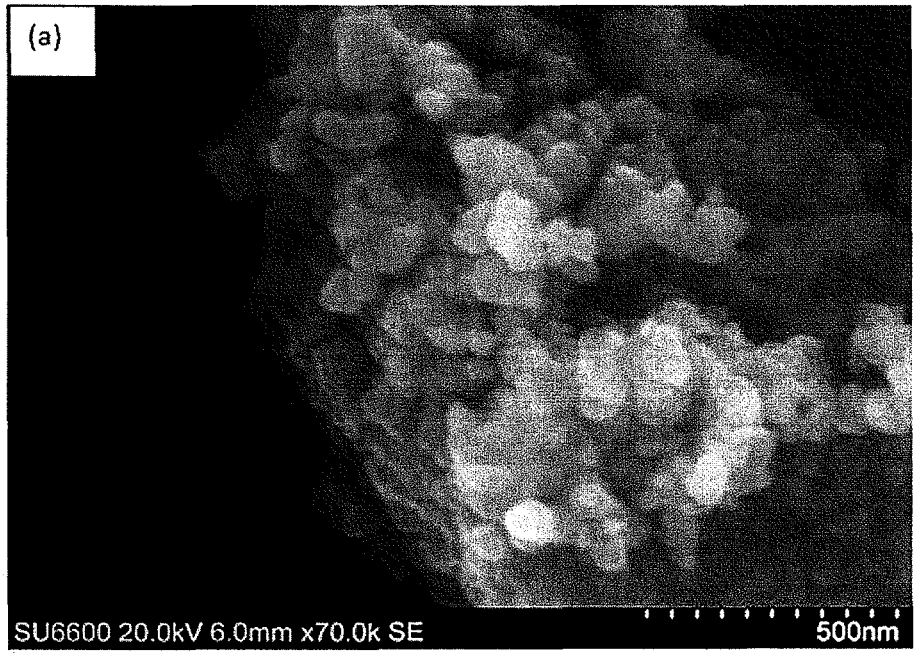
Figure 5B:
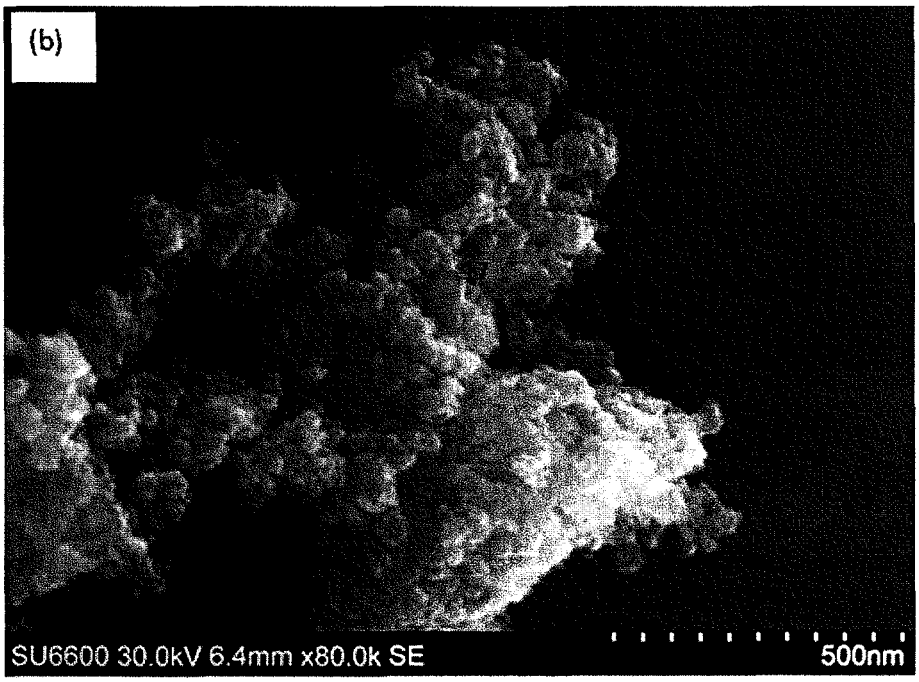
Figure 6A:
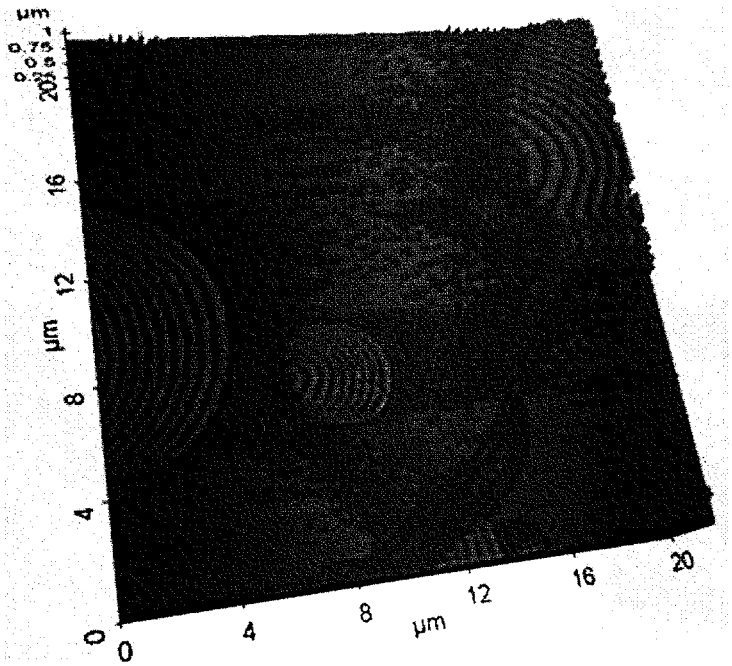
Figure 6B:
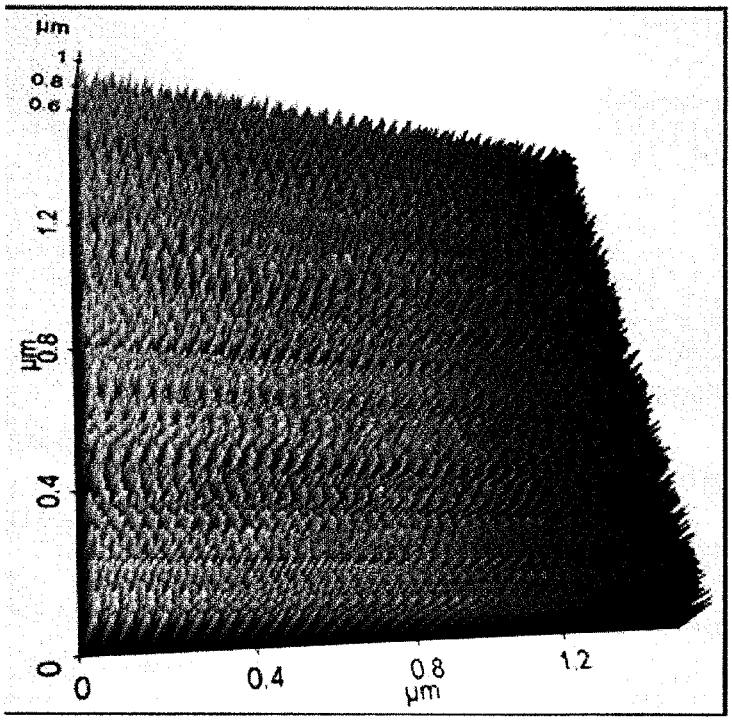

SEM images (see FIGS. 5A & 5B) of magnetite nanoparticles prepared using 1 mm and 0.5 mm zirconium oxide grinding balls in the two final grinding stages ((d) and (e)) established the approximate particle size as being 30 and 20 nm, respectively. The morphology further revealed that magnetite particles had a uniform size distribution and a regular shape. AFM images (see FIGS. 6A & 6B) further corroborated the SEM results.

$Fe^{2+}$:$Fe^{3+}$ ratio in the magnetic ore was calculated by a chemical method. The ore sample was dissolved in 10 ml of 13 M HCl acid under inert atmosphere at room temperature. The dissolved solution was filtered and was diluted up to 250 ml using distilled water.

25.00 ml of above solution was pipetted out into a titration flask. 5 ml of syrupy phosphoric acid and 28 ml of 1 M $H_2SO_4$ acid was also added in to the same titration flask and was titrated with 0.01 M $KMnO_4$ to determine the amount of Fe+2.

3 g of Zn granules were added to another 25.00 ml portion of above prepared solution to reduce Fe+3 ions in to Fe+2 ions. 5 ml of syrupy phosphoric acid and 28 ml of 1 M $H_2SO_4$ acid was added in to the same titration flask and was titrated with 0.01 M $KMnO_4$. According to the burette readings, the ratio between Fe2+ and Fe3+ ions in the magnetite ore was found to be 1:2.

That which is claimed:

1. A process for making magnetite nanoparticle dispersions, wherein substantially all of the nanoparticles have a particle size of about 32 nm, consisting of:

(a) providing a magnetite ore;

(b) destructuring the magnetite ore, wherein (i) the destructuring of the magnetic ore is done by grinding in a nano-grinder in the presence of oleic acid using at least one of tungsten carbide grinding balls or zirconium oxide grinding balls and (ii) the grinding is performed in an inert atmosphere with:

15 mm size tungsten carbide grinding balls at 700 rpm for about one hour, further grinding using 5 mm size tungsten carbide grinding balls at 700 rpm for about one hour, further grinding using 3 mm size zirconium oxide grinding balls at 1000 rpm for about one hour, and further grinding using 1 mm size zirconium oxide grinding balls at 1000 rpm for about one hour;

(c) contacting the destructured magnetite ore with one of the group consisting of a long chain alkyl carboxylic acid, a natural oil containing long chain carboxylic acid carboxyl groups, and combinations thereof to form stabilized nanoparticles; and (d) dispersing the stabilized nanoparticles in alcoholic solvent.

2. The process of claim 1 wherein the nano-grinder is a FRITSCH Planeten—Micromuhle Pulverisette 7 premium line nano-grinder.

3. A process for making magnetite nanoparticle dispersions, wherein substantially all of the nanoparticles have a particle size of about 21 nm, consisting of:

(a) providing a magnetite ore;

(b) destructuring the magnetite ore, wherein (i) the destructuring of the magnetic ore is done by grinding in a nano-grinder in the presence of oleic acid using at least one of tungsten carbide grinding balls or zirconium oxide grinding balls and (ii) the grinding is performed in an inert atmosphere with:

15 mm size tungsten carbide grinding balls at 700 rpm for about one hour, further grinding using 5 mm size tungsten carbide grinding balls at 700 rpm for about one hour, further grinding using 3 mm size zirconium oxide grinding balls at 1000 rpm for about one hour, further grinding using 1 mm size zirconium oxide grinding balls at 1000 rpm for about one hour, and further grinding using 0.5 mm size zirconium oxide grinding balls at 1000 rpm for about one hour;

(c) contacting the destructured magnetite ore with one of the group consisting of a long chain alkyl carboxylic acid, a natural oil containing long chain carboxylic acid carboxyl groups, and combinations thereof to form stabilized nanoparticles; and (d) dispersing the stabilized nanoparticles in alcoholic solvent.

4. The process of claim 3 wherein the nano-grinder is a FRITSCH Planeten—Micromuhle Pulverisette 7 premium line nano-grinder.

5. The process of claim 1 or claim 3 wherein the long chain alkyl carboxylic acid is selected from the group consisting of capric acid, lauric acid, myristic acid, oleic acid, and palmitic acid, and mixtures thereof.

* * * * *